US005339064A

United States Patent [19]

Bessho

[11] Patent Number: 5,339,064

[45] Date of Patent: Aug. 16, 1994

[54] MAGNETIC FLUX CONVERGING TYPE HIGH SPEED ELECTROMAGNET

[76] Inventor: Kazuo Bessho, 10-37, Hashiba-Cho, Kanazawa City, Ishikawa Pref., Japan

[21] Appl. No.: 992,006

[22] Filed: Dec. 17, 1992

[30] Foreign Application Priority Data

Dec. 26, 1991 [JP] Japan ..... 3-356831

[51] Int. Cl.[5] ..... H01F 5/00; H01F 3/00

[52] U.S. Cl. ..... 335/282; 335/281; 335/297; 335/299

[58] Field of Search ..... 335/281, 282, 256, 266, 335/296, 297

[56] References Cited

U.S. PATENT DOCUMENTS

| | | | |
|---|---|---|---|
| 1,807,956 | 6/1931 | Apple | 335/256 |
| 3,124,726 | 3/1964 | Howland | 335/296 |
| 3,185,909 | 5/1965 | Jahn | 335/296 |
| 3,231,842 | 1/1966 | Brower | 335/282 |
| 3,576,473 | 4/1971 | Genbauffe | 335/256 |
| 4,455,543 | 6/1984 | Pischinger | 335/266 |
| 4,686,501 | 8/1987 | Palmier | 335/256 |
| 4,855,703 | 8/1989 | Bessho | 335/296 |
| 4,857,874 | 8/1989 | Bessho | 335/296 |
| 4,879,539 | 11/1989 | Bessho | 335/299 |
| 4,933,657 | 6/1990 | Bessho | 335/299 |
| 4,987,398 | 1/1991 | Bessho | 335/299 |

FOREIGN PATENT DOCUMENTS

| | | | |
|---|---|---|---|
| 0788214 | 12/1978 | U.S.S.R. | 335/266 |

*Primary Examiner*—Leo P. Picard
*Assistant Examiner*—Stephen T. Ryan
*Attorney, Agent, or Firm*—Spencer, Frank & Schneider

[57] ABSTRACT

A magnetic flux converging type high speed electromagnet comprising a magnetic frame and an exciting coil assembly positioned within the frame. The exciting coil assembly includes a plurality of series-connected exciting coil portions spaced from each other along a longitudinal axis and a plurality of conductor plates interposed between the coil portions. Each of the conductor plates is provided with a hollow cylindrical member having a slit extending in the longitudinal direction which is continuous with a radial slit in the conductor plate, and each of the hollow cylindrical members extends along the longitudinal axis from a corresponding conductor plate toward a first end of the magnetic frame. A first end conductor plate not having the hollow cylindrical member is interposed between the first end of the magnetic frame and an adjacent exciting coil portion of the exciting coil assembly. A second end conductor plate having a hollow cylindrical member is interposed between a second end of said magnetic frame and another adjacent exciting coil portion of the exciting coil assembly.

8 Claims, 13 Drawing Sheets

MAGNETIC FLUX CONVERGING TYPE HIGH SPEED ELECTROMAGNET

BACKGROUND OF THE INVENTION

1. Field of the Invention

The present invention relates to a magnetic flux converging type high speed electromagnet of efficient magnetic excitation and shortened response time.

2. Related Art Statement

As is well known, in the conventional electromagnet, the following methods (a ) and (b) are generally adopted for attaining high speed action:

(a) Supplying a large current to an exciting coil for increasing the attracting force of the magnet.

(b) Shortening the response time by increasing the resistance of an exciting coil for reducing the time constant thereof, particularly in a high speed electromagnet utilized for a high speed relay and other applications.

Accordingly, whichever methods (a) and (b) is adopted, it is required to supply a high voltage to the exciting coil.

However, after the attraction has been effected by the electromagnet, the function thereof can be sufficiently maintained even by a small exciting current. Thus, the electric power supplied by a high voltage source for the initial attraction is not needed thereafter and hence is almost entirely wasted.

Moreover, when method (a) is adopted, even if the magnetomotive force is strengthened by supplying a large current to the exciting coil, so as to increase the amount of magnetic flux, the leakage magnetic flux is relatively increased. Consequently, method (a) has an avoidable defect in that the effective magnetic fluxes required for attraction are reduced in response to the increase of leakage magnetic flux.

On the other hand, if method (b) is adopted, the same defect as in the above case cannot be avoided.

SUMMARY OF THE INVENTION

The present invention has been conceived by referring to the above mentioned defects of the conventional technical state.

An object of the present invention is to provide a magnetic flux converging type high speed electromagnet in which the leakage magnetic flux is reduced by the operation of an eddy current, so as to increase the effective magnetic flux and hence reduce the electric power loss. At the same time, a large current is supplied with a comparatively low voltage, particularly in the case of a dc electromagnet, to reduce an equivalent time constant by the operation of an eddy current which is generated only during the attraction in a transient state, so as to facilitate the expectation of the shortened response time.

For attaining the above object, a magnetic flux converging type high speed electromagnet according to the present invention is featured in that plural exciting coil portions, which have individually the same central hollows, are concentrically arranged and inserted in each of the interspaces thereof individually with plural conductor plates each of which has substantially the same central hollow as that of the exciting coil portion and further a radial slit extended from the central hollow to the periphery.

Another magnetic flux converging type high speed electromagnet according to the present invention is featured in that plural exciting coil portions, which have individually the same central hollows, are concentrically arranged in series so as to form an exciting coil assembly and provided in each of interspaces thereof individually and at both ends of the exciting coil assembly with plural conductor plates each of which has substantially the same central hollow as that of the exciting coil portion and further a radial slit extended from the central hollows to the periphery and still further each of which, except one provided on one end of the exciting coil assembly, is provided with a short hollow cylinder having substantially the same inner diameter as that of the central hollow and coaxially extended on one side only by substantially the same length as the thickness of the exciting coil portion, the short hollow cylinder further having a radial slit which is continued with the radial slit formed on the conductor plate.

Still another magnetic flux converting type high speed electromagnet according to the present invention is featured in that the plural conductor plates provided with the short hollow cylinders therebetween are unitarily formed, so as to provide a winding spool for the exciting coil assembly.

Further still another magnetic flux converting type high speed electromagnet according to the present invention is featured in that an assembly of plural exciting coil portions and plural conductor plates, which are alternately arranged in series and individually provided with central hollows continued with each other, is surrounded with plural outer magnetic material frames and a pair of fixed and movable magnetic material cylinders confronting with each other, so as to provide an electromagnetic plunger.

In the magnetic flux converging type high speed electromagnet arranged as mentioned above according to the present invention, the magnetomotive force which is generated by applying ac or dc voltage across the exciting coil induces magnetic fluxes in the magnetic material frame surrounding the exciting coil, and, although these magnetic fluxes induced in the surrounding magnetic material frame were leaked through the exciting coil surrounded by the frame in the conventional arrangement, the leakage of induced magnetic fluxes is prevented by the function of eddy currents induced in the conductor plates individually inserted in the interspaces of the exciting coil portions composing the exciting coil, and, as a result, almost all of the magnetic fluxes induced in the surrounding magnetic material frame is converged in the magnetic material cylinders provided through serially continued central hollows individually formed in the exciting coil portions and the conductor plates inserted in each of interspaces of those coil portions in the axial direction, so as to effectively act as the attracting force.

Particularly in the case that an ac voltage is applied across the exciting coil, eddy currents converged in central portions of the inserted conductor plates are operated as secondary ac currents and hence the input primary ac current increased, and, as a result, the generated attracting force is remarkably increased in comparison with that in the conventional electromagnet applied with the same voltage.

On the other hand, in the case that a dc voltage is applied on the exciting coil, in the transient state in which the current is increased in response to the application of dc voltage and further the movable magnetic material cylinder provided through central hollows of the exciting coil portions and the conductor plates individually inserted therebetween is moved in the axial direction, eddy currents are induced in the conductor plates as if in the same condition as in the case that an ac voltage is applied, so that the input current is increased in response to this condition and, as a result, the attracting force in the initial transient state is increased and hence the electromagnet is operated at a high speed in a manner similar to that which occurs if the time constant is reduced.

BRIEF DESCRIPTION OF THE DRAWINGS

For the better understanding of the invention, reference is made to the accompanying drawings, in which.

Throughout different views of the drawings: $x_1$, $x_2$, $x_3$ are plunger type electromagnets; $\mathbf{1}_1$, $\mathbf{1}_2$, $\mathbf{1}_3$ are exciting coil portions; 2 is an exciting coil assembly ; 3, 6 are centrally located apertures of hollows; $\mathbf{5}_1$, $\mathbf{5}_2$ are conductor plates; $\mathbf{5}_3$ is a winding spool; 7, 9 are slits; 8 is a short cylinder; 10 is a magnetic material frame; 20 is an acting portion; 21 is a guide cylinder; 22, 23 are magnetic material bodies; is a gap; $\mathbf{30}_1$, $\mathbf{30}_2$ are electromagnets; $\mathbf{41}_1$, $\mathbf{41}_2$ are exciting coils; $\mathbf{51}_1$, $\mathbf{51}_2$ are fixed iron cores; 52 is a movable iron core; 53 is a bearing.

DESCRIPTION OF THE PREFERRED EMBODIMENTS

Preferred embodiments of the present invention and operations thereof are precisely described hereinafter by referring to the accompanying drawings. In this connection, to avoid complicating the description, the same components and equivalent components are marked by the respectively same symbols, so as to omit respective descriptions.

In the first place, as a first embodiment of the present invention, a plunger type electromagnet $x_1$ will be described by referring to FIGS. 1 to 6.

Figure 1:
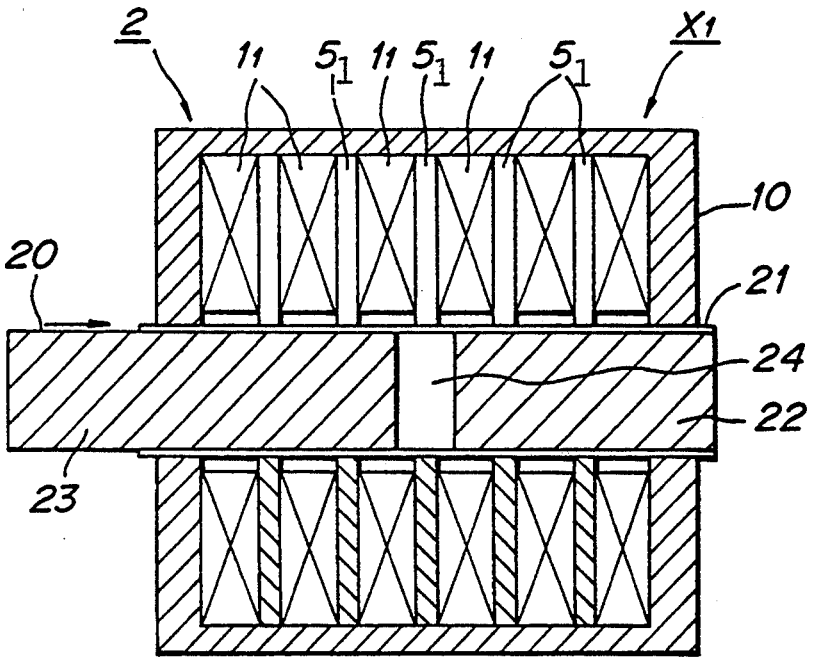
FIG. 1 is a crosssectional sideview showing a first embodiment of a plunger type electromagnet according to the present invention.
Figure 2:
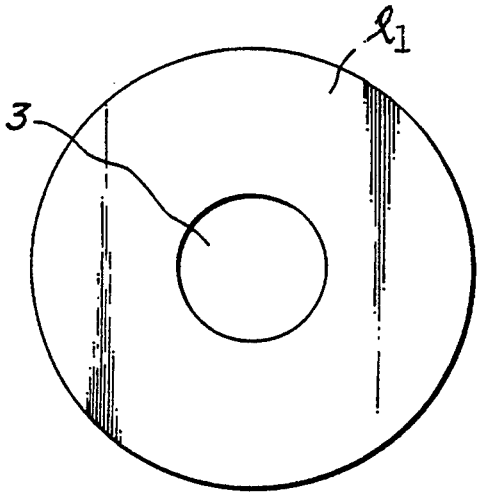
FIG. 2 is an elevation showing an annular exciting coil in the first embodiment.
Figure 3:
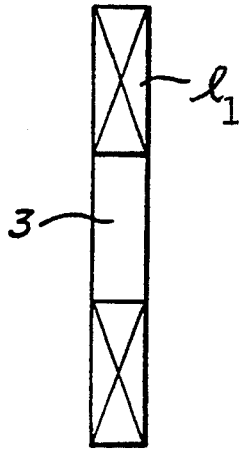
FIG. 3 is a crosssectional sideview showing the same annular exciting coil.
Figure 4:
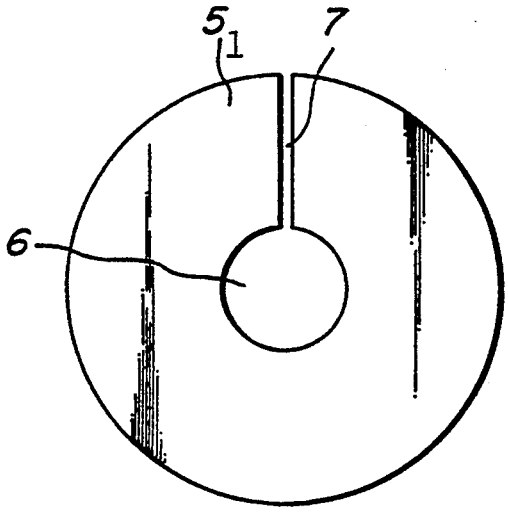
FIG. 4 is an elevation showing a circular conductor plate in the first embodiment.
Figure 5:
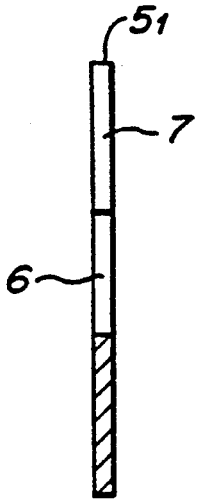
FIG. 5 is a crosssectional sideview showing the same circular conductor plate.
Figure 6:
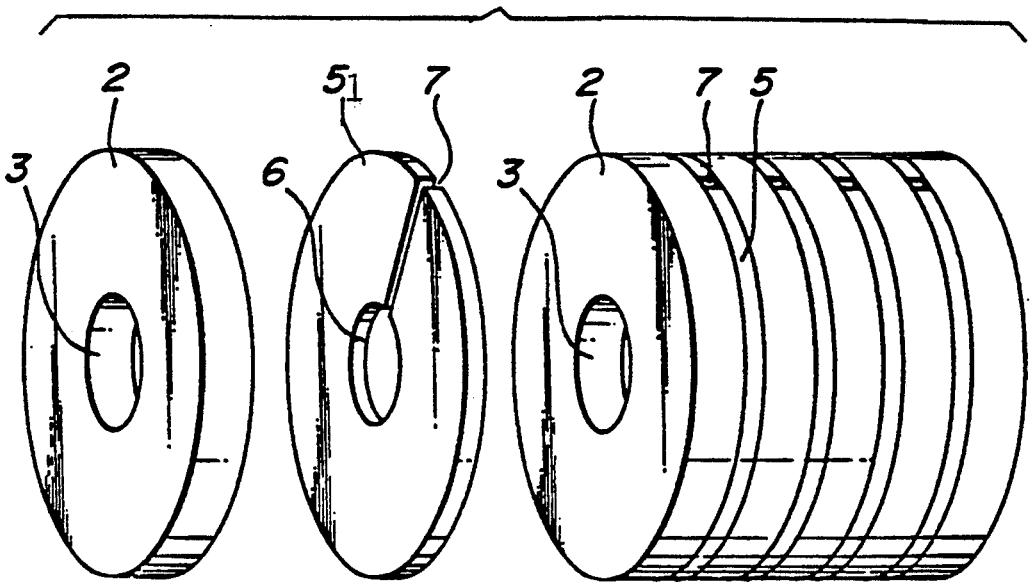
FIG. 6 is a partially developed perspective view showing an assembly of the same exciting coils and the same conductor plates.

In FIG. 1 showing a crosssectional sideview of a plunger type electromagnet $x_1$, exciting coil portions $\mathbf{1}_1$ as shown in FIGS. 2 and 3 and conductor plates $\mathbf{5}_1$ as shown in FIGS. 4 and 5 are alternately stacked as shown in FIG. 6, so as to provide an exciting coil assembly 2 which features the present invention. This exciting coil assembly is entirely surrounded by a magnetic frame 10 formed of ferrimagnetic material as an enclosure and a pair of fixed and movable magnetic cylinders 22 and 23 which are formed of ferrimagnetic material also and are confronted with each other through a guide cylinder 21, a gap 24 being left therebetween, so as to be operated as an acting portion 20 of a plunger.

In this connection, the exciting coil portion 11 is regarded as one of plural annular sections formed by dividing an exciting coil of a conventional electromagnet and hence has a central hollow 3 as shown in FIGS. 2 and 3. The circular conductor plate $\mathbf{5}_1$ has an outer diameter substantially the same as that of the exciting coil portion $\mathbf{1}_1$ and a central hollow 6 having an inner diameter which is a little smaller than that of the central hollow 3 of the exciting coil portion $\mathbf{1}_1$. Further, plate $\mathbf{5}_1$ has a radial slit 7 extended from the central hollow 6 to a periphery thereof. Plural exciting coil portions $\mathbf{1}_1$ and plural conductor plate $\mathbf{5}_1$ are alternately, coaxially and closely arranged in series as shown in FIG. 6, so as to compose the exciting coil of the electromagnet.

In this exciting coil assembly, the guide cylinder 21 formed of dielectric material is fixedly inserted through the central hollows 3 and 6 of the exciting coil portions $\mathbf{1}_1$ and the circular conductor plates $\mathbf{5}_1$ which are alternately stacked, and which define a centrally located cylindrical volume of substantially uniform diameter. Further, in this guide cylinder 21, the fixed and the movable magnetic material cylinders 22 and 23 are confronted with each other so that the gap 21 is left therebetween.

Accordingly, when an ac or dc voltage is applied across the exciting coil 2 assembly, magnetically exciting currents flow in each of exciting coil portions $\mathbf{1}_1$ and hence induce magnetic fluxes in the magnetic frame 10 and eddy currents in each of conductor plates $\mathbf{5}_1$. The which eddy currents are obstructed by each of the slits 7 and then converged around the central hollows 6, so as to induce magnetic fluxes in these hollows 6. As a result, all of these magnetic fluxes flow through the fixed and the movable magnetic material cylinders 22 and 23 and hence the attracting force is effected between magnetic cylinders 22 and 23 through the gap 24. Consequently, the movable magnetic cylinder 23 is attracted toward the fixed magnetic cylinder 24 so as to act as a piston of the plunger.

Figure 7:
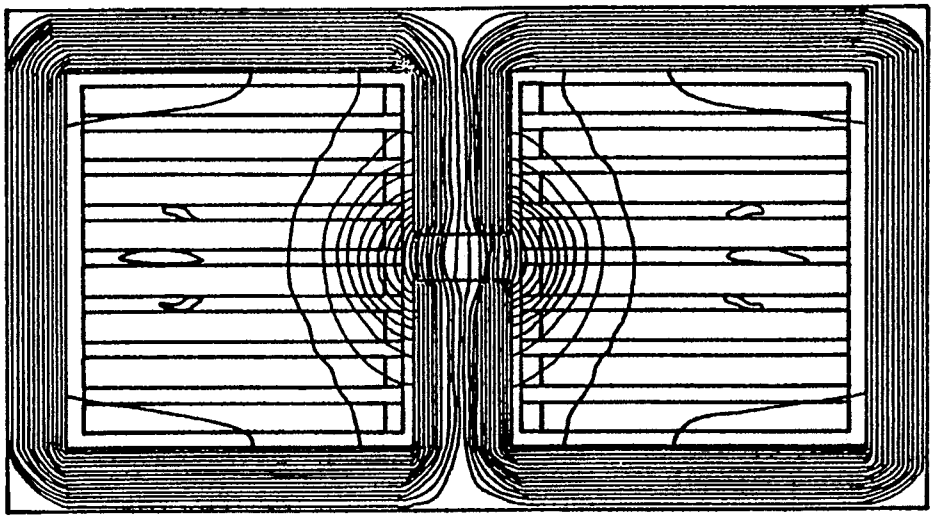
FIG. 7 is a crosssectional sideview showing a distribution of magnetic fluxes in the first embodiment in case an ac voltage is applied thereon.
Figure 8:
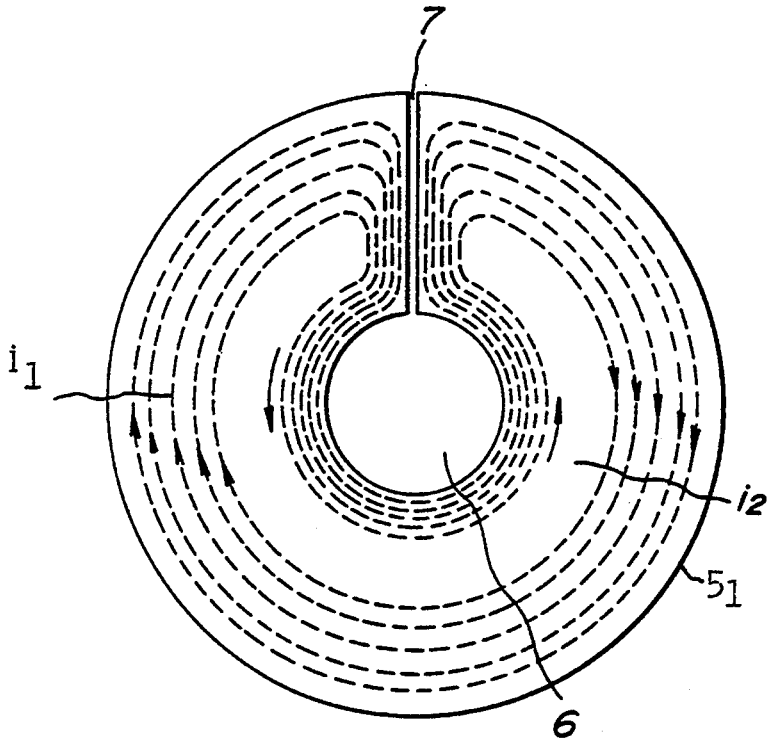
FIG. 8 is an elevation showing the state of eddy currents flowing in the same circular conductor plate.

In the above mentioned first embodiment Of the present invention, when an ac voltage is applied across the exciting coil assembly 2, magnetic fluxes are distributed in the electromagnet $x_1$ as shown in FIG. 7. In this connection, when ac magnetic fluxes are generated by the application of an ac voltage to the exciting coil portions $1_1$, an electromotive force in the direction opposite to the exciting current is generated in the circular conductor plate $5_1$, in the peripheral portion of which eddy currents $i_1$ flow in response to this electromotive force as shown in FIG. 8. The eddy currents il are obstructed by the radial slit 7 and turned toward the central hollow 6, and, as a result, eddy currents $i_2$ converged around the central hollow 6 flow in the same direction as that of the exciting current, so as to converge ac magnetic fluxes in the central hollow 6.

Figure 9:
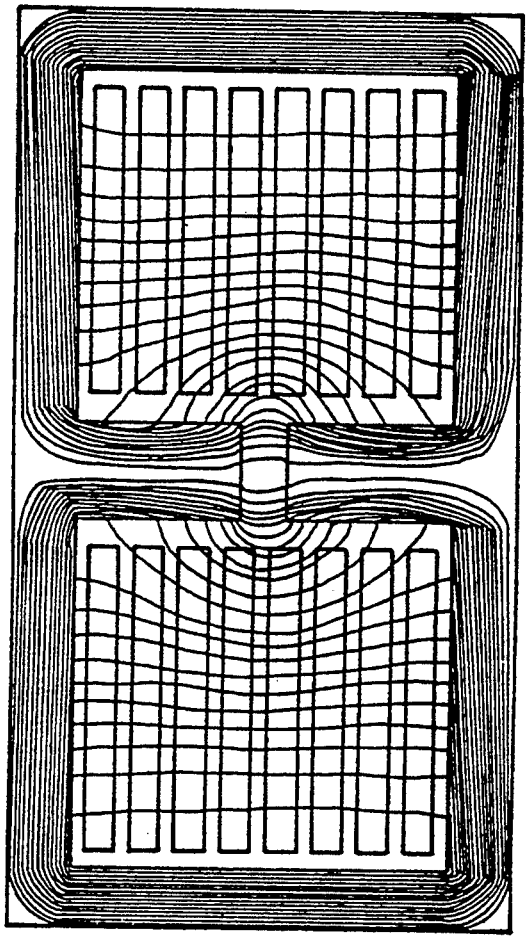
FIG 9 PRIOR ART
FIG. 9 is a crosssectional sideview showing a distribution of magnetic fluxes in a conventional plunger type electromagnet.

A comparison of the magnetic flux distribution according to the present invention as shown in FIG. 7 with the magnetic flux distribution in a conventional plunger type electromagnet shown in FIG. 9, which corresponds to the embodiment $x_1$ comprising exciting coil portions $1_1$ without the circular conductor plates $5_1$ inserted therebetween, an be made by comparing 9. In the conventional electromagnet of FIG. 9, FIG. 7 and leakage magnetic fluxes through the exciting coil portions $1_1$, which are obstructed by the conductor plates $5_1$ in the embodiment $x_1$, are remarkably increased, so that the effective magnetic fluxes, which pass through the movable magnetic cylinder positioned in the central portion of the electromagnet, are decreased in response to the increase of leakage magnetic fluxes, and, as a result, the attracting force is remarkably reduced.

In short, according to the present invention, the leakage magnetic fluxes through the exciting coil portions are reduced in response to the function of the eddy currents flowing in the conductor plates and hence almost all of the generated magnetic fluxes are converged within the central hollows 6 and, as a result, the attracting force is remarkably intensified.

Figure 10:
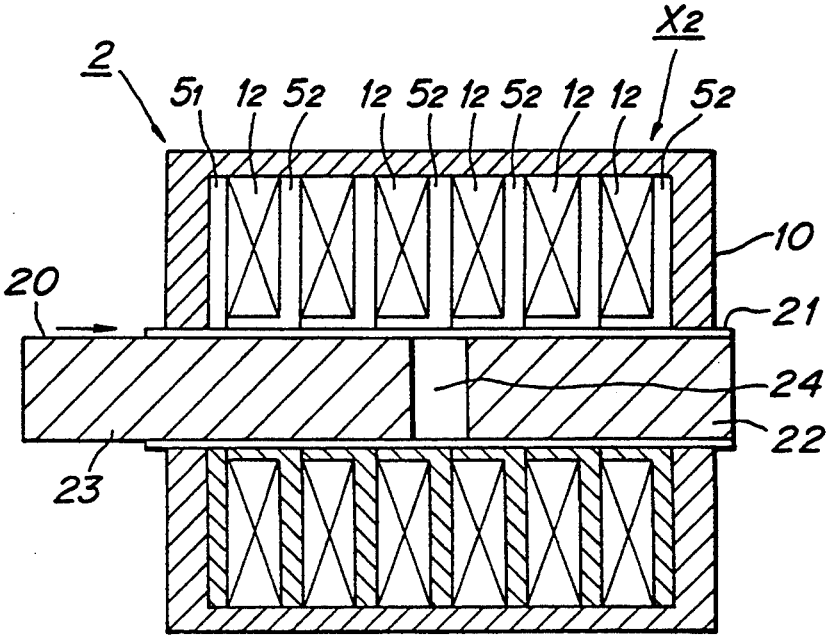
FIG. 10 is a crosssectional sideview showing a second embodiment of the same plunger type electromagnet according to the present invention.
Figure 11:
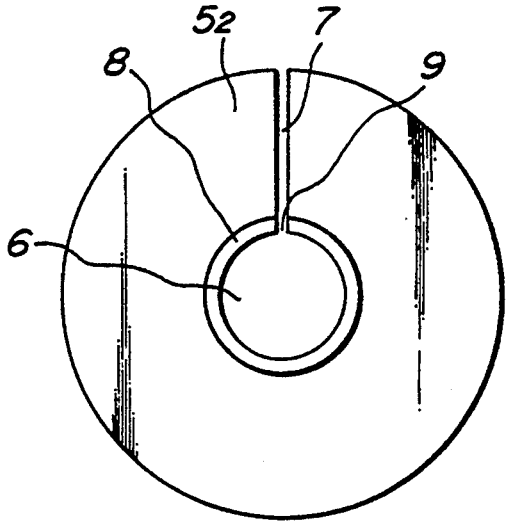
FIG. 11 is an elevation showing a circular conductor plate in the second embodiment.
Figure 12:
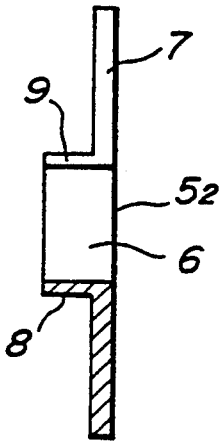
FIG. 12 is a crosssectional sideview showing the same circular conductor plate.

In a second embodiment of the invention, a plunger type electromagnet designated $x_2$ is shown in FIG. 10 to 12 as a second embodiment of the present invention. The difference of this second embodiment $x_2$ from the aforesaid first embodiment $x_1$ is as follows.

Plural exciting coil portions $1_2$ are formed in the same way as those of the first embodiment $x_1$ shown in FIGS. 2 and 3, so as to provide the exciting coil assembly 2.

In this exciting coil assembly, a circular conductor plate $5_1$, which is formed in the same way as that of the embodiment $x_1$ shown in FIGS. 4 and 5, is arranged at one end of the exciting coil assembly 2. At the other end thereof and in each of the interspaces of the exciting coil portions $1_2$, plural conductor plates $5_2$ are arranged, each of which has a circular conductor plate portion having the same configuration as that of the embodiment $x_1$ shown in FIGS. 4 and 5. Further, a short hollow cylinder 8 which has an inner diameter which is the same as that of the central hollow 6 of the circular portion, is coaxially extended on one side only toward the conductor plate $5_1$ by substantially the same length as the thickness of the exciting coil portion $1_2$. The short hollow cylinder 8 has a radial slit as shown in FIGS. 11 and 12, which slit 9 is continued with the radial slit 7 formed on the circular plate portion.

Consequently, in the second embodiment $x_2$, the convergence of eddy currents around the central hollows 6 and the obstruction of leakage magnetic fluxes are improved by providing an electrically continuous arrangement of plural conductor plates in contact with each other, as a readily manufacturable unitary structure, through short hollow cylinders individually extended from each of the conductor plates.

Figure 13:
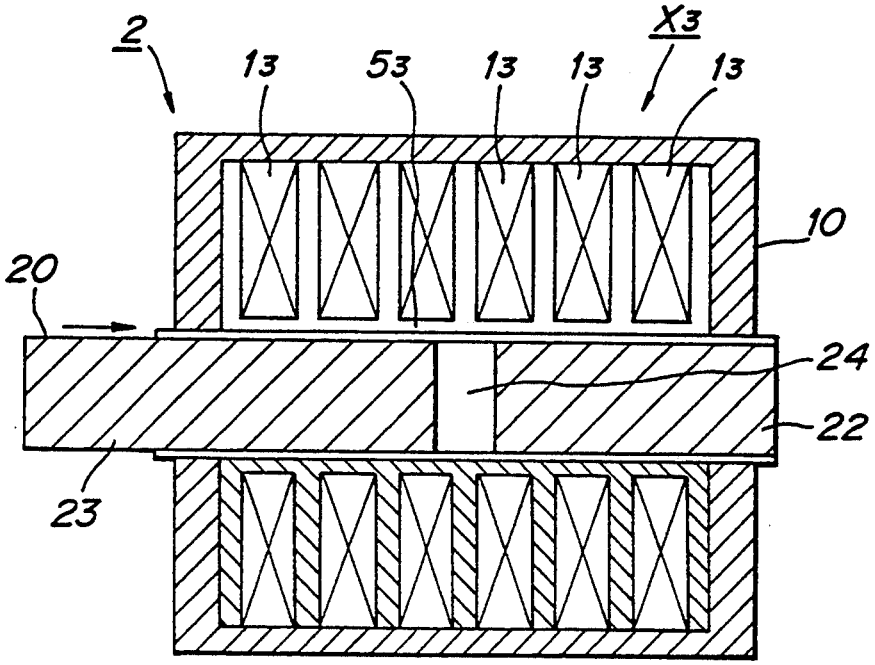
FIG. 13 is a crosssectional sideview showing a third embodiment of the same plunger type electromagnet according to the present invention.
Figure 15:
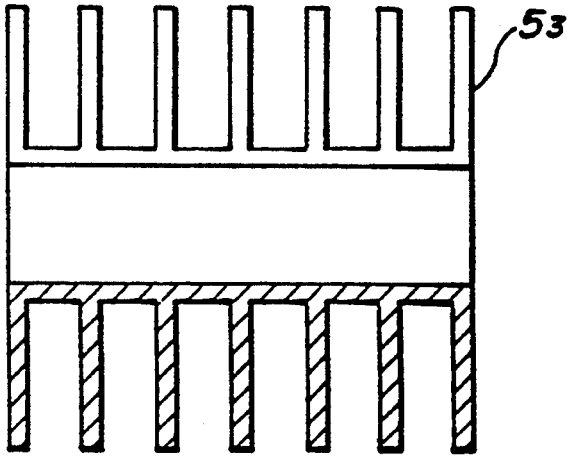
FIG. 15 is a crosssectional sideview showing the same winding spool.

In a third embodiment of the invention, a plunger type electromagnet marked by $x_3$ is shown in FIGS. 13 and 15. The difference of this third embodiment $x_3$ from the aforesaid second embodiment $x_2$ is as follows.

Figure 14:
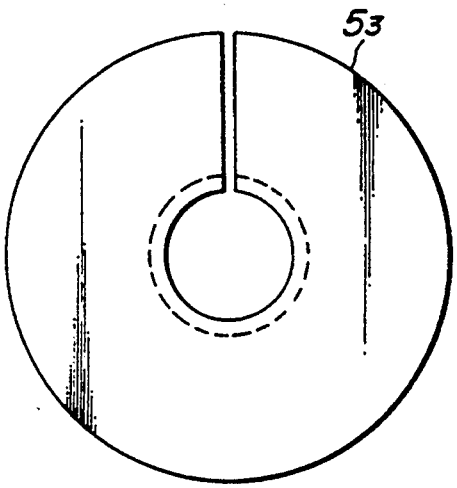
FIG. 14 is an elevation showing a circular winding spool for an exciting coil in the third embodiment.

In the third embodiment $x_3$, the circular conductor plates $5_1$ and $5_3$ in the second embodiment $x_2$ are serially arranged such that each of the slits 7 and 9 of all of these circular conductor plates $5_1$ and $5_2$ are unitarily continued, so as to provide a winding spool $5_3$ of unitary structure as shown in FIGS. 14 and 15 for the exciting coil assembly.

Figure 16:
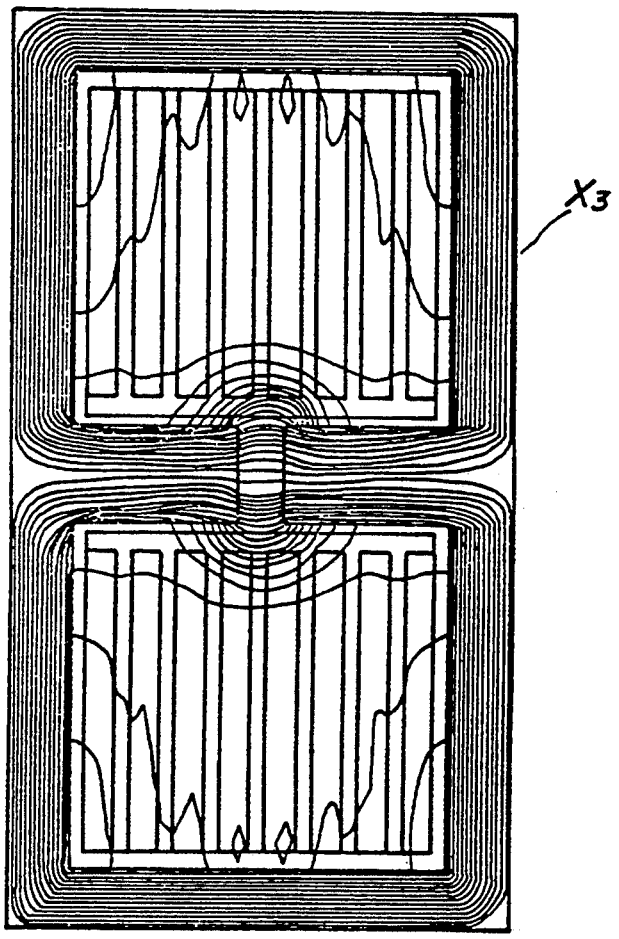
FIG. 16 is a crosssectional sideview showing a distribution of magnetic fluxes in the third embodiment in case an ac voltage is applied thereon.

In the aforesaid second and third embodiments of the present invention, when the ac voltage is applied across the exciting coil assembly 2, magnetic fluxes are distributed in the electromagnet $x_2$ and $x_3$ as shown in FIG. 16, which is substantially the same as shown in FIG. 7. Accordingly, a similar or improved result as achieved in that the leakage magnetic fluxes are decreased in response to the induced eddy currents and hence the effective magnetic fluxes in the central portion thereof are increased, so as to intensify the attracting force according to the electrically continuous structure of conductor plates inserted between exciting coils.

Figure 17:
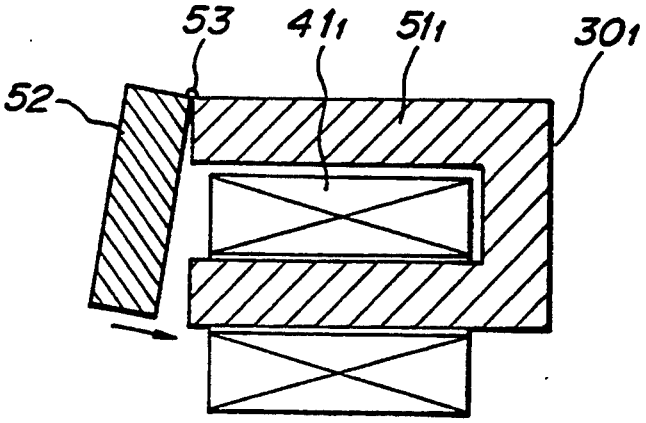
FIG. 17 is a crosssectional sideview showing an assembly of an exciting coil and magnetic cores in another type of electromagnet according to the present invention.

In all of the embodiments, the magnetic flux converging type exciting coil assembly, which is featured by the present invention, is applied on the plunger type electromagnet. In connection with these embodiments, this magnetic flux converging type exciting coil assembly can be applied also on a different type electromagnet, for example, a hinge type electromagnet as shown in FIG. 17. FIG. 17 shows an electromagnet $30_1$ of a type such that an exciting coil $41_1$ is wound on a leg of a fixed iron core $51_1$, while a movable iron core 52 is rotatably affixed to another leg of the fixed iron core $51_1$. In this type of electromagnet, the exciting coil $41_1$ can be replaced with the exciting coil assembly according to the present invention, so as to obtain a function and an effect which are similar those obtained with the aforesaid embodiments. In this connection, the same function and effect are obtained with a solenoid type electromagnet.

Figure 18:
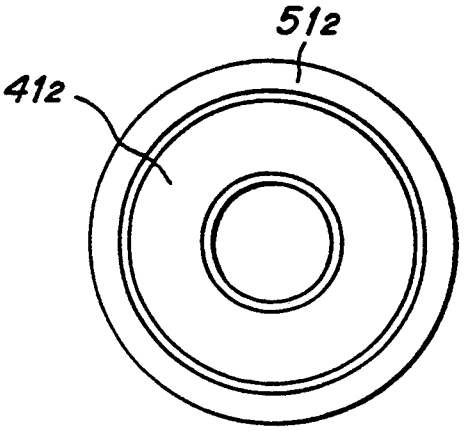
FIG. 18 is an elevation showing an assembly of an exciting coil and magnetic material cores in still another type electromagnet according to the present invention.
Figure 19:
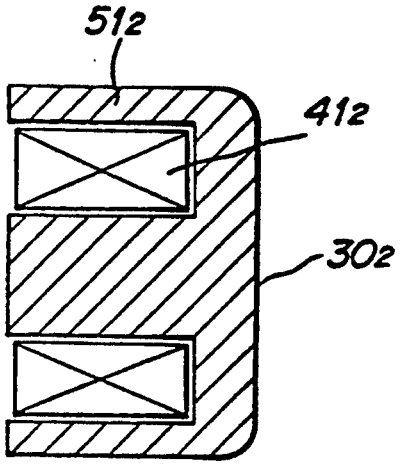
FIG. 19 is a crosssectional sideview showing the same assembly.

FIGS. 18 and 19 show an electromagnet $30_2$ of such a type wherein an exciting coil $41_2$ and an iron core $51_2$ are comprised as the subjective bodies, which is used in a case such that iron plates and the like are attracted and moved by a crane or the like. When the electromagnet $30_2$ of this type is used as an ac electromagnet, the exciting coil $41_2$ can be replaced with the aforesaid exciting coil assembly according to the present invention, so a function and an effect which are similar to those obtained in the aforesaid embodiments.

Figure 20:
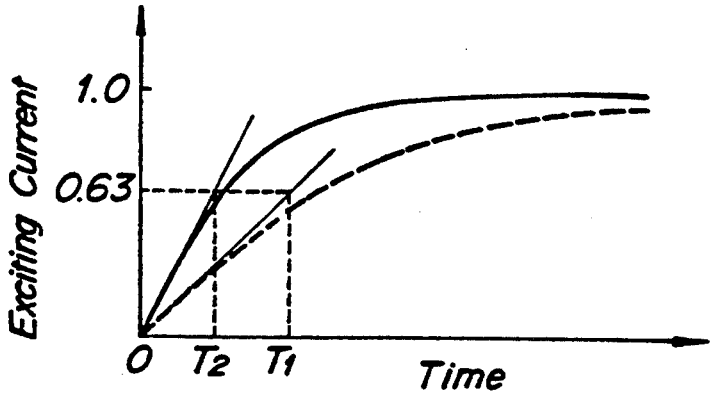
FIG. 20 is a diagram showing characteristic curves of an exciting coil in an electromagnet according to the present invention.

In case the electromagnets of the aforesaid embodiments are applied with a dc voltage, the increases with the lapse of time of the exciting current flowing in the exciting coil is indicated by curves shown in FIG. 20. In FIG. 20, a dotted curve indicates the exciting current when the time constant $T_1$ of the exciting coil is large, while a solid curve indicates the exciting current when the time constant $T_2$ is small. As is apparent from these curves, the smaller the time constant of the exciting coil, the more rapid the riseup of the exciting current becomes and hence the more rapid the attracting force increases so as to realize a high speed electromagnet.

On the other hand, when an ac voltage is applied to the electromagnets of the aforesaid embodiments, eddy currents are induced in the conductor plates $5_1$, $5_2$ or in the winding spool $5_3$, so as to prevent the leakage of magnetic fluxes and hence to increase the effective magnetic fluxes required for generating the attracting force.

In addition, in the transient condition immediately after a dc voltage is applied to these electromagnets, eddy currents flow in a manner which is similar to the case in which an ac voltage is applied to the electromagnet. That is, in this transient condition, eddy currents are obtained which function in a manner similar to the secondary eddy currents in the case that an ac voltage is applied. As a result, the primary input current is increased. Consequently, the time constant of the exciting coil is equivalently reduced and hence the response speed of the electromagnet is raised, so as to realize a high speed electromagnet.

As is apparent from the above description, according to the present invention, the rise of the exciting current in response to the voltage application is accelerated by the function of eddy currents flowing in the conductor plates or the winding spool which are used for the exciting coil assembly, as if the time constant of the exciting coil is reduced, and hence the attracting force is rapidly increased. As a result, provision of a magnetic flux converging type high speed electromagnet which is steadily operated is facilitated.

What is claimed is:

1. A magnetic flux converging type high speed electromagnet, comprising a magnetic frame having a longitudinal axis; and an exciting coil assembly positioned within said magnetic frame, said exciting coil assembly including a plurality of series-connected exciting coil portions spaced from each other along said longitudinal axis, each of said exciting coil portions having a first centrally located aperture surrounding said longitudinal axis; and a plurality of conductor plates, each of said conductor plates having a second centrally located aperture of substantially the same diameter as said first centrally located aperture and having a radial slit therein which extends from said second aperture to a periphery of said conductor plate, each of said conductor plates being interposed between a pair of said exciting coil portions thereby forming a centrally located cylindrical volume of substantially uniform diameter defined by said first and second apertures, each of said plurality of conductor plates being further provided with a hollow cylindrical member surrounding said second aperture, having substantially the same diameter as said second aperture, and having a slit therein extending in said longitudinal direction which is continuous with the radial slit in said conductor plate, each of said hollow cylindrical members extending along said longitudinal axis from a corresponding conductor plate toward a first end of said magnetic frame; and wherein a first end conductor plate not having said hollow cylindrical member is interposed between the first end of said magnetic frame and an adjacent exciting coil portion of said exciting coil assembly, and a second end conductor plate having said hollow cylindrical member is interposed between a second end of said magnetic frame and another adjacent exciting coil portion of said exciting coil assembly.

2. A magnetic flux converging type high speed electromagnet as claimed in claim 1 wherein the plurality of conductor plates having said hollow cylindrical members are interconnected to form an integral unit, whereby an electrically continuous structure is provided to form a readily manufacturable unitary structure.

3. A magnetic flux converging type high speed electromagnet as claimed in claim 1 which further comprises a movable magnetic member displaceable within said cylindrical volume along said longitudinal axis when a voltage is applied to said series-connected exciting coil portions of said exciting coil assembly.

4. A magnetic flux converging type high speed electromagnet as claimed in claim 3 wherein said movable magnetic member is a movable magnetic cylinder, and which further comprises a fixed magnetic cylinder confronting said movable magnetic cylinder.

5. A magnetic flux converging type high speed electromagnet as claimed in claim 4 which further comprises a guide cylinder located between said exciting coil assembly and said movable and fixed magnetic cylinders.

6. A magnetic flux converging type high speed electromagnet member displaceable within said cylindrical volume along said longitudinal axis when a voltage is applied to said series-connected exciting coil portions of said exciting coil assembly.

7. A magnetic flux converging type high speed electromagnet as claimed in claim 6 wherein said movable magnetic member is a movable magnetic cylinder, and which further comprises a fixed magnetic cylinder confronting said movable magnetic cylinder.

8. A magnetic flux converging type high speed electromagnet as claimed in claim 7 which further comprises a guide cylinder located between said exciting coil assembly and said movable and fixed magnetic cylinders.

* * * * *